US010236618B1

(12) United States Patent
Irish et al.

(10) Patent No.: US 10,236,618 B1
(45) Date of Patent: Mar. 19, 2019

(54) CONNECTOR ASSEMBLY WITH DRESS COVER

(71) Applicant: Sumitomo Wiring Systems, Ltd., Yokkaichi-shi, Mie (JP)

(72) Inventors: Danielle Irish, Farmington Hills, MI (US); Eric Torrey, Farmington Hills, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/835,324

(22) Filed: Dec. 7, 2017

(51) Int. Cl.
*H01R 13/58* (2006.01)
*H01R 13/516* (2006.01)
*H01R 13/506* (2006.01)

(52) U.S. Cl.
CPC ..... *H01R 13/516* (2013.01); *H01R 13/506* (2013.01); *H01R 13/582* (2013.01)

(58) Field of Classification Search
CPC H01R 13/516; H01R 13/506; H01R 13/5808; H01R 13/595
USPC ..... 439/468, 465
See application file for complete search history.

(56) References Cited

U.S. PATENT DOCUMENTS 5,076,802 A 12/1991 Colleran et al.
5,947,762 A * 9/1999 Katsuma ..... H01R 13/5202 439/157
6,174,193 B1 * 1/2001 Nagano ..... H01R 13/506 439/468
6,811,424 B2 11/2004 Seminara et al.
6,817,888 B2 * 11/2004 Kozono ..... H01R 13/62933 439/468
7,241,183 B2 7/2007 Wasalaski et al.
7,267,564 B2 9/2007 Bauman et al.
7,476,121 B2 1/2009 Tsuji
7,524,215 B2 * 4/2009 Banas ..... H01R 13/506 439/465
7,661,981 B2 2/2010 Cross et al.
7,713,081 B2 * 5/2010 Chen ..... H01R 9/037 439/409
2016/0352039 A1 12/2016 Yamaki et al.

FOREIGN PATENT DOCUMENTS

CN 201230030 Y 4/2009
CN 102280763 A 12/2011

* cited by examiner

*Primary Examiner* — Hien D Vu
(74) *Attorney, Agent, or Firm* — Honigman LLP

(57) ABSTRACT

A connector assembly is configured to withstand the bending force of a bundle of wires exerted onto the dress cover so as to maintain the engagement of the dress cover to the connector housing. The connector housing includes a locking tab is an outer surface of the connector housing. The dress cover includes a hood defining an exit path on one end for which the wire bundle is routed. The dress cover includes a locking leg configured to engage the locking tab so as to secure the dress cover to the connector housing. The connector housing further includes a reinforcing tab disposed on an inner surface of the dress cover and spaced apart from the locking leg. The locking leg and the reinforcement tab cooperate to pinch a side wall of the connector housing and help secure the engagement between the locking leg and the locking tab.

12 Claims, 7 Drawing Sheets

CONNECTOR ASSEMBLY WITH DRESS COVER

TECHNICAL FIELD

The specification generally relates to connector assemblies and more particularly to connector assemblies having a dress cover configured to withstand the load of a compressed wire bundle.

BACKGROUND

In general, connector assemblies include a connector housing and a dress cover. The connector housing includes a plurality of terminal openings configured to receive a plurality of wires. The wires are protected by a dress cover.

The wires are bundled together and routed through an exit path of the dress cover. The dress cover is then mounted onto the connector housing, sandwiching the wires and protecting the wires. However, the bent bundle of wires exert a force on the dress cover. In some instances, the force may overcome the engagement force between the locking legs of the dress cover and corresponding locking tabs formed on the side walls of the connector housing.

In general, the dress cover may include four locking legs disposed on the side walls of the dress cover. The locking legs may be generally U shaped so as to define a slot. The connector housing is a block shaped member with a plurality of terminal openings extending along an axis generally orthogonal to the axial length of the connector housing. A corresponding number of locking tabs are disposed on the side walls of the connector housing.

The dress cover is simply mounted over the top opening of the connector housing wherein the locking legs are positioned such that the locking tabs are seated within a respective slot of the locking legs. The dress cover is mounted after the wires have been installed, and the wires may be bundled together and bent so as to align with the exit path. The bending of the wires may exert a large force onto conventional dress covers which causes the locking legs to break.

Accordingly, it remains desirable to have a connector housing assembly wherein the locking legs are reinforced so as to withstand the force exerted by the bent wires.

SUMMARY

In one embodiment a connector assembly is configured to withstand the bending force of a bundle of wires exerted onto the dress cover so as to maintain the engagement of the dress cover to the connector housing. The connector housing includes a pair of side walls opposite of each other and a front wall opposite of a back wall so as to form a generally block shaped member.

The connector housing includes plurality of terminal openings. The terminal openings provide through holes for which male and female terminal connectors are engaged. The wires are connected to the terminals and are bundled together on a top surface of the connector housing.

The connector housing further includes a locking tab. The locking tab is formed on an outer surface of one of the first side walls. The locking tab may be ramp shaped, wherein a top end of the locking tab is flush with the first side surface and angles to a bottom end. The bottom end of the locking tab may be planar and disposed on a plane orthogonal to the first side wall.

The connector assembly includes a dress cover. The dress cover includes a pair of second side walls, a second back wall, a second front wall and a second top wall connected to each other so as to define a storage space. A hood is formed over an opening of the front wall. The hood defines an exit path on one end. The exit path is a path for which the wire bundle is routed.

The dress cover includes a locking leg disposed on an outer surface of the second side walls. The locking leg is generally U-shaped so as to define a slot having a closed bottom end. The locking leg is configured to engage the locking tab of the connector housing so as to secure the dress cover to the connector housing. It should be appreciated that the connector assembly may have a plurality of locking legs and locking tabs.

The connector housing further includes a reinforcing tab. The reinforcing tab is disposed on the inner surface of the second side walls and is spaced apart from locking leg. The locking leg and the reinforcement tab cooperate together to pinch the first side wall of the connector housing and help secure the engagement between the locking leg and the locking tab.

In one embodiment, the connector housing includes a reinforcing rib. The reinforcing rib is disposed on an outer surface of the first side wall. The reinforcing rib extends beyond a top edge of the first wall.

The dress cover further includes a receiving slit. The receiving slit is disposed on the second side wall and is configured to receive the reinforcing rib so as to prevent the dress cover and connector housing from being displaced from each other relative to the axial length of the connector assembly.

In one embodiment, the dress cover includes a corner wrap structure. The corner wrap structure is configured to provide reinforcement to the respective locking legs and is configured to ride against respective front and back walls of the connector housing. In one embodiment the corner wrap structures are a generally solid body integrally formed to an elongated member of the locking legs and includes a portion which extends generally orthogonal to the locking legs.

Accordingly, the connector assembly is configured to withstand the forces of a compressed bundle of wire by providing reinforcement to the locking legs in multi planar directions as well as to maintain the spatial relationship of the second side walls so as to prevent the force exerted by the bending wires from breaking the locking legs.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings where like structure is indicated with like reference numerals and in which:

DETAILED DESCRIPTION OF THE PREFERRED EMBODIMENTS

Figure 1:
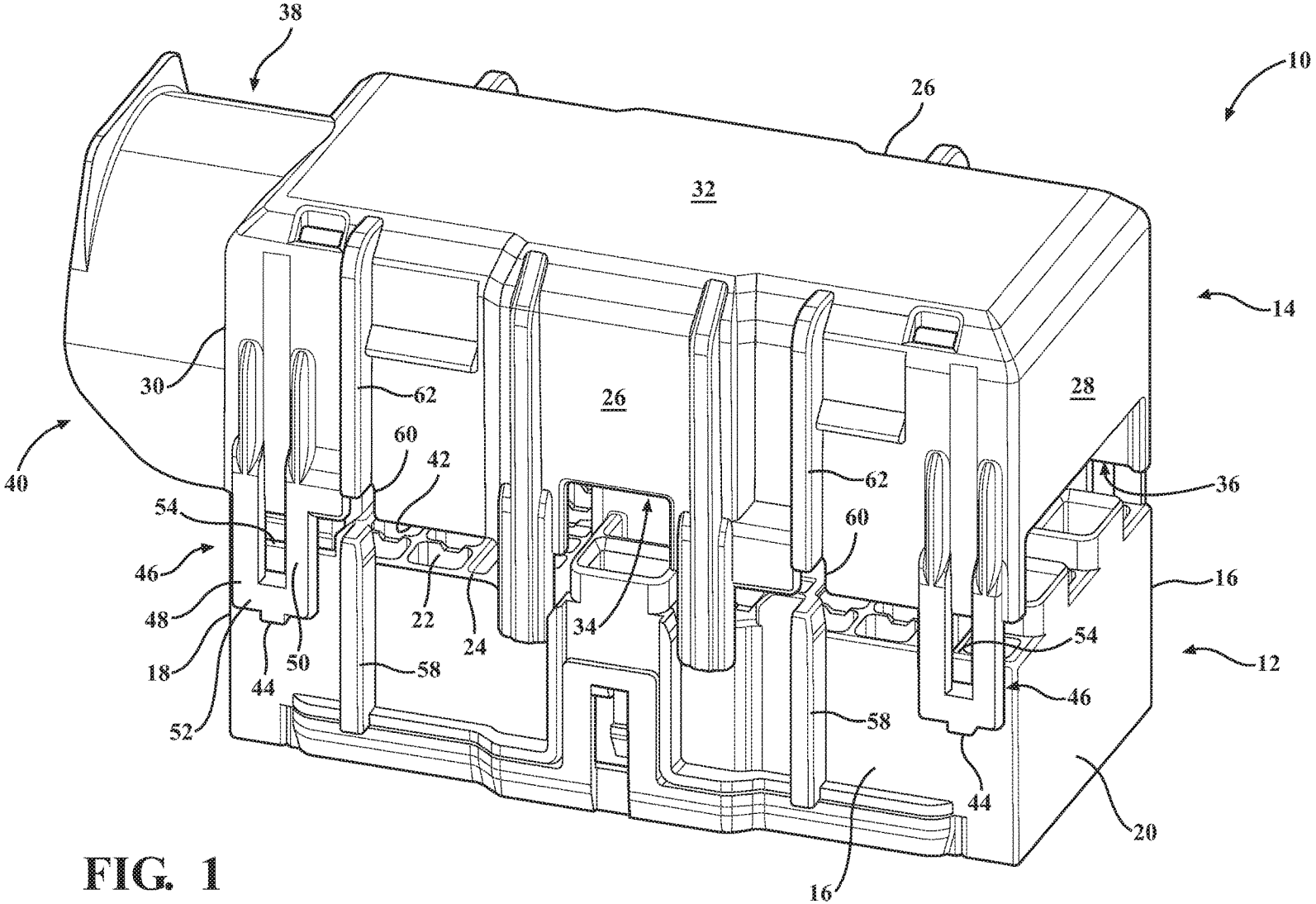
FIG. 1 schematically depicts a connector assembly in accordance with one or more embodiments described and illustrated herein.

Referring generally to the figures, embodiments of the present disclosure include a connector assembly configured to withstand the force applied by compressed wire bundles. In particular, the connector assembly is configured to displace the load of the compressed wire bundles so as to maintain a locked position.

The connector housing includes a locking tab. The locking tab is formed on an outer surface of one of the first side walls. The locking tab may be ramp shaped, wherein a top end of the locking tab is flush with the first side surface and angles to a bottom end. The bottom end of the locking tab may be planar and disposed on a plane orthogonal to the first side wall.

The dress cover includes a locking leg disposed on an outer surface of the second side walls. The locking leg is generally U-shaped so as to define a slot having a closed bottom end. The locking leg is configured to engage the locking tab of the connector housing so as to secure the dress cover to the connector housing.

A reinforcing tab is disposed on the inner surface of the second side walls and is spaced apart from the locking leg. The locking leg and the reinforcement tab cooperate together to pinch the first side wall of the connector housing and help secure the engagement between the locking leg and the locking tab. Accordingly, load from the compressed bundle of wires is distributed to the reinforcement tab so as to help the locking leg retain a locked position with the locking tab.

As used herein, the term "proximal" refers to the portion of the figure adjacent the exit path and the term "distal" refers to the portion of the dress cover opposite the proximal end. References to the term "top" and "bottom" are made with respect to the orientation of the parts shown in the drawings.

Figure 2:
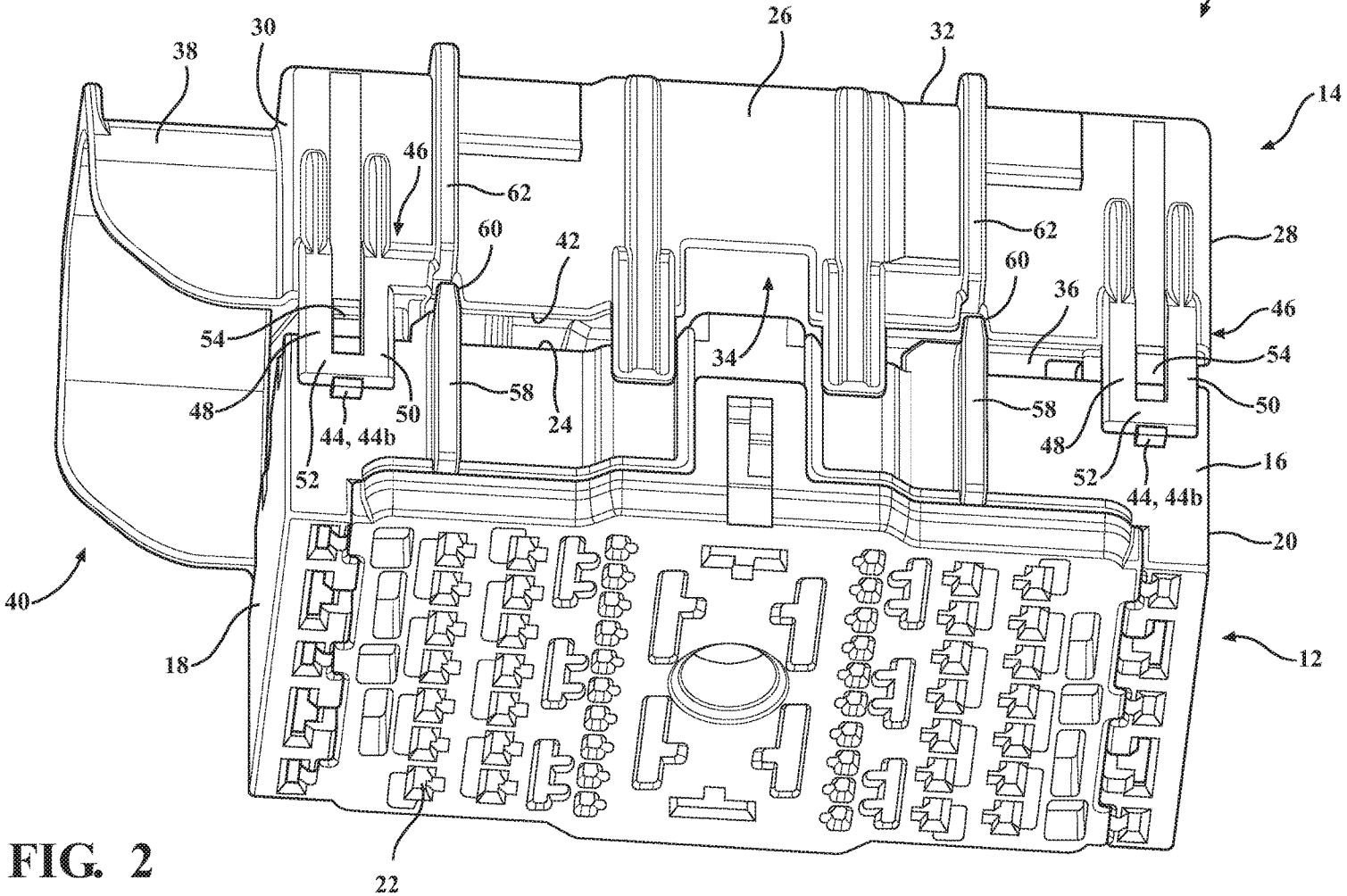
FIG. 2 is a bottom view of the connector assembly shown in FIG. 1.

With reference now to FIGS. 1 and 2, a perspective view of an illustrative embodiment of the connector assembly 10 is provided. The connector assembly 10 includes a connector housing 12 and a dress cover 14 configured to be secured to the connector housing 12 and withstand the reactive load of a compressed bundle of wire, also referenced as a wire bundle, (not shown). FIG. 1 shows the dress cover 14 separated from the connector housing 12. The connector housing 12 and the dress cover 14 may be formed of a durable and resilient material suitable for use in the injection molded process, such material illustratively includes polypropylene.

The connector housing 12 includes a pair of first side walls 16 opposite of each other and a first front wall 18 opposite of a first back wall 20 so as to form a generally block shaped member. The connector housing 12 further includes a plurality of terminal openings 22. The terminal openings 22 are configured to receive a plurality of terminal connectors. It should be appreciated that the terminal openings 22 may vary in size with respect to each other to accommodate terminal connectors of different diameters. Further, the number of terminal openings 22 depicted herein are provided for illustrative purposes and is not limiting to the scope of the appended claims.

The terminal openings 22 provide through holes for which male and female terminal connectors (not shown) are engaged. FIG. 2 shows the bottom opening of each of the terminal openings 22 and illustrates how a terminal connector may be seated into the bottom of the connector housing 12. The wires are connected to the terminals and the terminals are inserted into the top opening of the terminal openings 22 so as to be disposed on the top surface of the connector hosing 12. The wires are bundled together so as to form a wire bundle on the top surface of the connector housing 12. The top surface of the first side walls 16, first front wall 18 and first back wall 20 include a first peripheral edge 24 which is generally disposed on the same plane.

The dress cover 14 includes a pair of second side walls 26, a second back wall 28 opposite a second front wall 30 and a second top wall 32 so as to define storage space 34 having an open bottom 36. The storage space 34 is configured to accommodate the bundled wire; however, packaging constraints often require that the storage space 34 be minimized such that the wire bundle is compressed by the dress cover 14.

The second front wall 30 includes a hood 38 and is open so as to define an exit path 40 through which a wire bundle may be routed. The second side walls 26 may be designed to have a predetermined height so as to accommodate a predetermined bundle of wire and a predetermined packaging space. The bottom surface of the second side walls 26, second front wall 30 and second back wall 28 include a second peripheral edge 42 which is generally disposed on the same plane.

Figure 3:
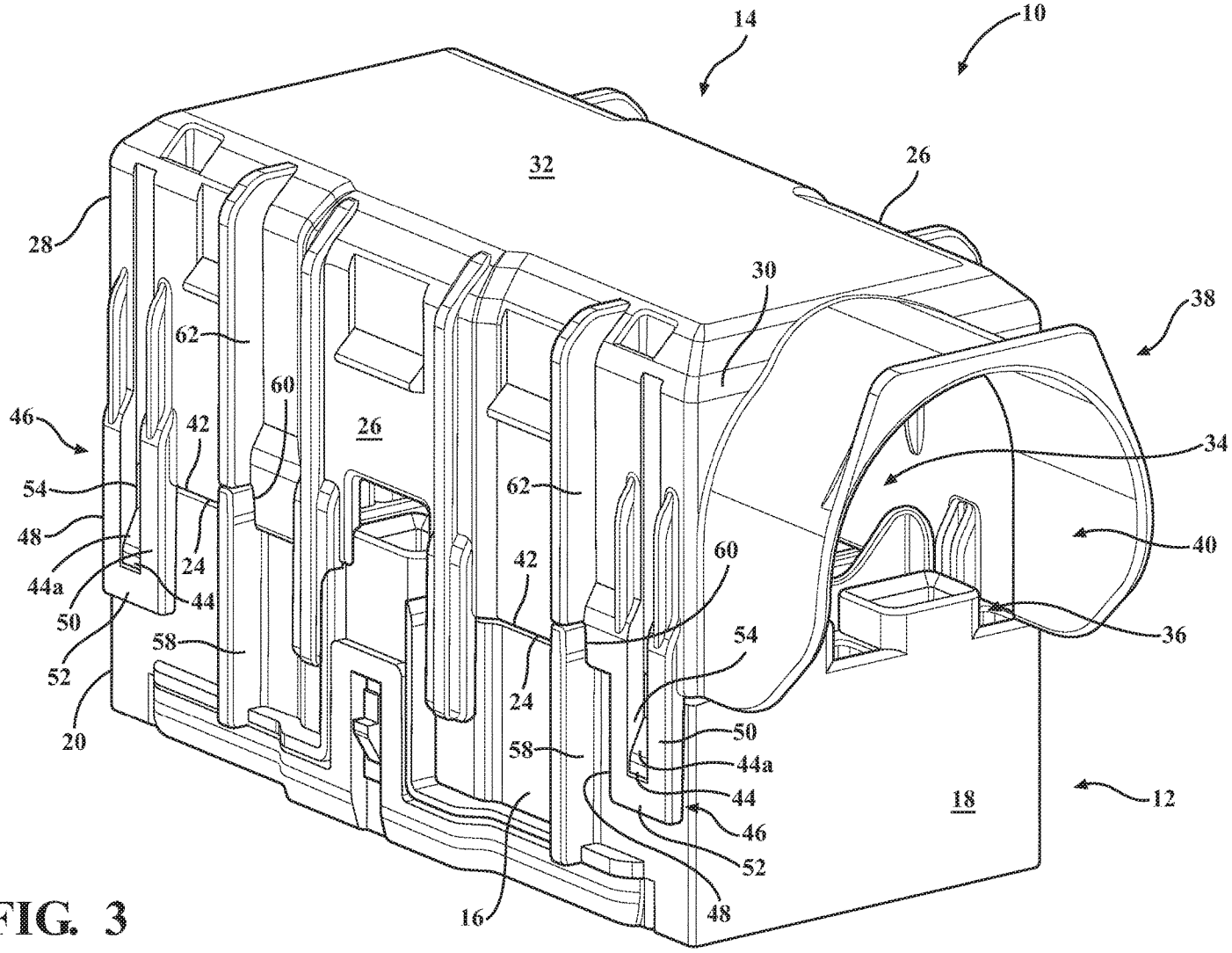
FIG. 3 is a view of FIG. 1 showing the dress cover fully mounted to the connector housing.

With reference now to FIG. 3, the connector assembly 10 is shown in a locked position, wherein the dress cover 14 is secured to the connector housing 12. In the locked position, the second peripheral edge 42 of the dress cover 14 is seatingly engaged with the first peripheral edge 24 of the connector housing 12.

The connector housing 12 includes a locking tab 44. The locking tab 44 is configured to engage the dress cover 14 so as to hold the dress cover 14 in a locked position with the connector housing 12. The locking tab 44 is formed on an outer surface of one of the first side walls 16. In one embodiment, the locking tab 44 is ramp shaped. A top end **44*a* of the locking tab 44 is flush with the outer surface of the first side wall 16 and angles to a bottom end 44*b*. The bottom end 44*b* of the locking tab 44 may be planar and disposed on a plane orthogonal to the first side wall 16**.

In one embodiment, the connector housing 12 includes four locking tabs 44. Each of the four locking tabs 44 is identical to the other. Each of the four locking tabs 44 is disposed on the corners of the connector housing 12 and are located adjacent the first peripheral edge 24 of the connector housing 12.

The dress cover 14 includes a locking leg 46 disposed on an outer surface of the second side walls 26. The locking leg 46 is configured to engage the locking tab 44 of the connector housing 12 so as to couple the dress cover 14 to the connector housing 12. In one embodiment, the locking leg 46 is integrally formed on the second side walls 26 of the dress cover 14.

The locking leg 46 includes a first elongated member 48 spaced apart from a second elongated member 50. The bottom end **44*b* of the first elongated member 48 is connected to the bottom end 44*b* of the second elongated member 50 by a lip 52 so as to define a closed bottom. The first and second elongated members 48, 50 are spaced apart from each other so as to define a slot 54. The slot 54 extends along an axis defining the length of the locking leg 46. The slot 54 has a width configured to slidingly receive the respective locking tabs 44 and secure the dress cover 14 to the connector housing 12. The locking leg 46 is formed of a resilient material configured to deflect outwardly relative to the outer surface of the dress cover 14. It should be appreciated that the connector assembly 10 may have a plurality of locking legs 46 and locking tabs 44**.

Figure 4:
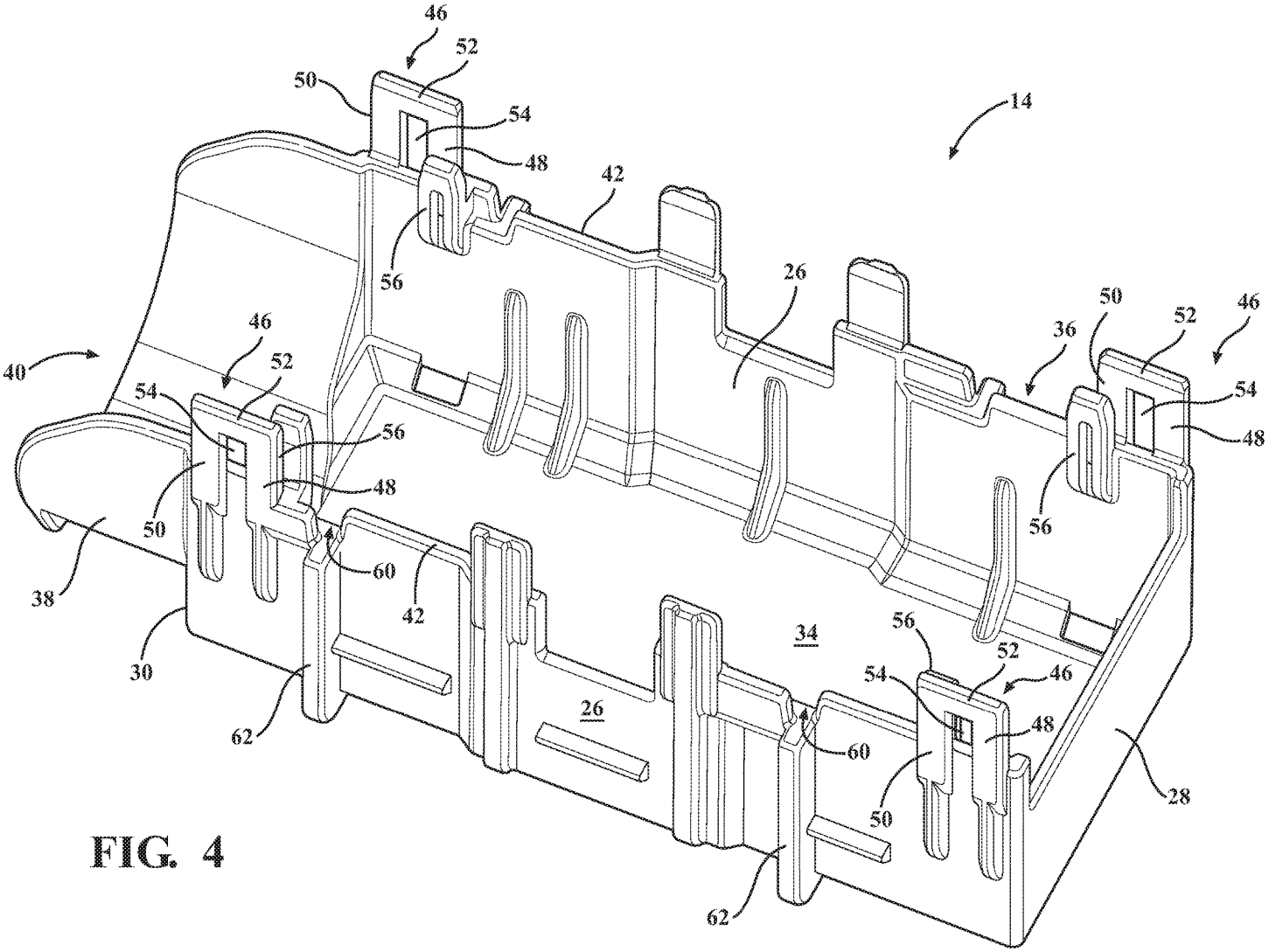
FIG. 4 is a view showing the interior of the dress cover.
Figure 5:
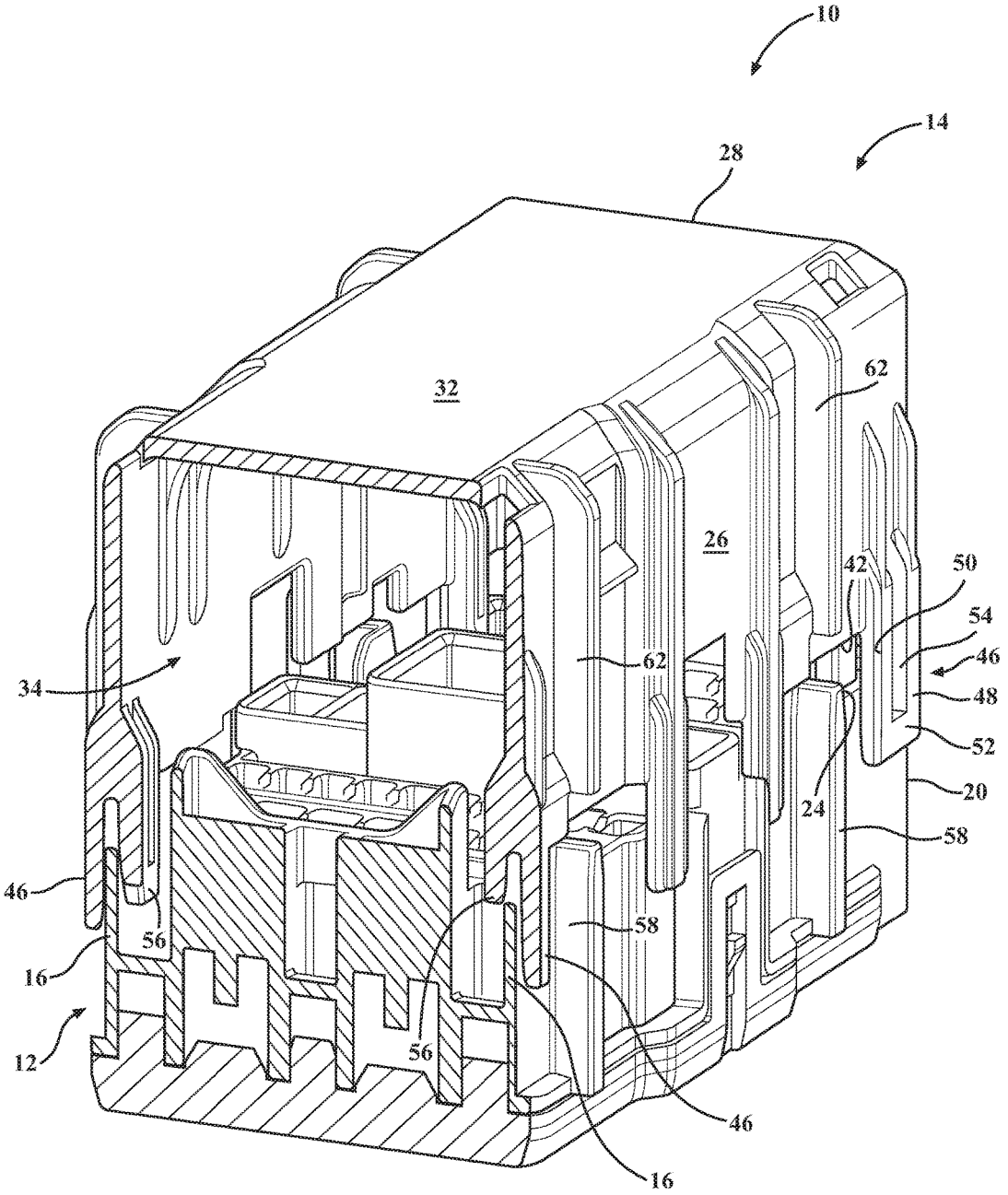
FIG. 5 is a cross-sectional view of FIG. 2 taken along line 5-5.

With reference now to FIGS. 4 and 5, the dress cover 14 includes a reinforcing tab 56. The reinforcing tab 56 is disposed on the inner surface of the second side walls 26 and is spaced apart from locking leg 46. The locking leg 46 and the reinforcing tab 56 cooperate together to pinch the first side wall 16 of the connector housing 12 and help secure the engagement between the locking leg 46 and the locking tab 44. The reinforcing tab 56 is a generally elongated member formed of a resilient material. The locking tab 44 extends beyond the second peripheral edge 42 of the dress cover 14 assembly. In one embodiment, the dress cover 14 includes the same number of locking tabs 44 as the locking legs 46.

The reinforcing tab 56 and the corresponding locking legs 46 are spaced apart a distance slightly less than the width of the first side wall 16. As the reinforcing tab 56 is a resilient member, the reinforcing member urges the locking leg 46 against the outer surface of the first side wall 16. In such a manner the locking leg 46 is pressed into engagement along the width of the connector housing 12.

In operation, wires are inserted into the terminal openings 22 of the connector housing 12. The wires are bundled together to form a wire bundle. The dress cover 14 is mounted onto the connector housing 12. The wire bundled is bent and directed out the exit path 40, under the hood 38 of the dress cover 14. The wires may be bundled together using known bundling methods such as tape or a zip lock or a tie. Naturally, the bent wire bundle exerts a compressive force on the dress cover 14, urging the dress cover 14 away from the connector housing 12.

The dress cover 14 is pressed onto the connector housing 12 in opposition of the force of the bent wire bundle. The locking legs 46 are slid over respective locking tabs 44. The locking legs 46 deflect outwardly as the locking legs 46 slide over the ramp shaped locking tabs 44. In particular, the lip 52 of the locking legs 46 slide over the ramp shaped locking legs 46 until the lip 52 passes the locking tabs 44, wherein the resiliency of the locking legs 46 snap the locking legs 46 against the first side wall 16 of the connector housing 12. The locking tabs 44 are seated within the respective slots 54, wherein the load of the compressed wire bundle urges the lip 52 of the locking legs 46 against the bottom end 44*b* of the respective locking tab 44.

The bundle of wire may further exert a radial force as the wire bundle is compressed. The radial force is applied to the second side walls 26 of the dress cover 14 which may cause the second side walls 26 to expand away from each other and separate the locking legs 46 from engagement with the locking tabs 44. As the reinforcing tab 56 slides against the inner surface of the first side walls 16. The locking legs 46 and the reinforcing tabs 56 pinch the first side wall 16. The reinforcing tab 56 urges the corresponding locking leg 46 into engagement with the outer surface of the first side wall 16, as shown in FIG. 5 despite the radial force expanding the second side walls 26 away from each other.

In one embodiment, the reinforcing tabs 56 are identical to each other, as shown in FIG. 4. FIG. 5 illustrates how the reinforcing tabs 56 may be offset from the corresponding locking legs 46, or may be directly opposite from a corresponding locking leg 46. In particular, FIG. 5 is a cross-section of FIG. 3 taken along 5-5. The reinforcing tabs 56 are offset from the corresponding locking leg 46 as indicated by the length of the two reinforcing tabs 56 as shown in FIG. 5.

Figure 6:
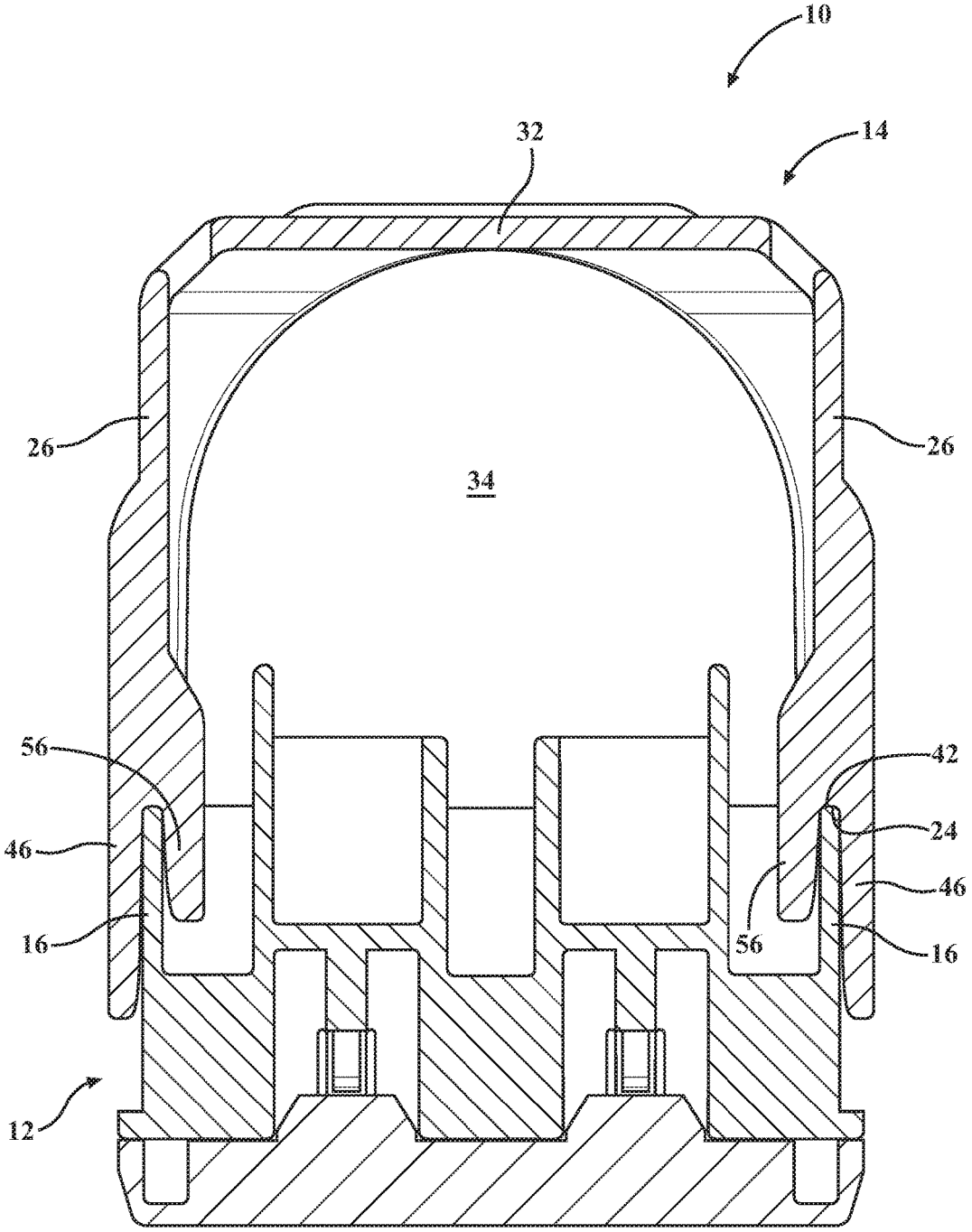
FIG. 6 is a cross-sectional view of FIG. 2 taken along line 6-6.

FIG. 5 is a cross-sectional view taken along the two locking legs 46 and reinforcing tabs 56 adjacent the hood 38. The reinforcing tabs 56 are not directly opposite of each other, but the corresponding locking legs 46 are. FIG. 6 shows, an example of the reinforcing tabs 56 being directly opposite of each other and opposite of the corresponding locking leg 46. Accordingly, it should be appreciated that the placement of the reinforcing tabs 56 depicted in the FIGS. are provided for illustrative purposes and is not limiting to the scope of the appended claims.

In one embodiment, the connector housing 12 includes a reinforcing rib 58. The reinforcing rib 58 is disposed on an outer surface of the first side wall 16. The reinforcing rib 58 is an elongated member having a width extending a predetermined distance from the outer surface of the first side wall 16. The reinforcing rib 58 extends beyond the first peripheral edge 24 of the first side wall 16.

The dress cover 14 further includes a receiving slit 60. The receiving slit 60 is disposed on the second side wall 26 and is configured to receive the reinforcing rib 58 so as to prevent the dress cover 14 and connector housing 12 from being displaced from each other relative to the axial length of the connector assembly 10. The dress cover 14 includes a fin 62. The fin 62 is disposed on the outer surface of the second side wall 26 and is axially aligned with the receiving slit 60.

In one embodiment, a reinforcing rib 58 is disposed on the outer surface of each of the first side walls 16, and a receiving slit 60 is disposed on each of the second side walls 26. The reinforcing ribs 58 are slid into a corresponding receiving slit 60 when the dress cover 14 is mounted onto the connector housing 12. As the reinforcing ribs 58 are engaged with a corresponding receiving slit 60, the dress cover 14 is fixed with respect to the connector housing 12 along an axis extend from the first back wall 20 to the second back wall 28. FIG. 3 illustrates how the reinforcing rib 58 is seated within a corresponding receiving slit 60 and a corresponding fin 62 is axially aligned with the reinforcing rib 58. Thus, the engagement of the reinforcement member with respect to the receiving slit 60 helps the locking legs 46 retain its position with respect to a corresponding locking tab 44.

In operation, the dress cover 14 is mounted onto the connector housing 12 after the wires have been installed in the connector housing 12 as described above. The reinforcing ribs 58 are seated within a respective receiving slit 60 wherein the first peripheral edge 24 of the connector housing 12 is seated against the second peripheral edge 42 of the dress cover 14.

In one embodiment, the dress cover 14 and the connector housing 12 may have a plurality of reinforcing ribs 58 and a corresponding number of receiving slits 60. The reinforcing ribs 58 and receiving slits 60 positioned in different locations so as to prevent a dress cover 14 intended for use with a particular connector housing 12 from being used with an intended connector housing 12. For example, a first type of dress cover 14 may have receiving slits 60 in a position as shown in the FIGS. and is intended for use with a second type of connector housing 12 having reinforcing ribs 58 in positions shown in the FIGS.

A second type of dress cover 14 (not shown) made have receiving slits 60 in a position different than what is shown in the FIGS. and is intended for use with a connector housing 12 having reinforcing ribs 58 located to engage the receiving slits 60 of the second type of dress cover 14. As such, the first type of dress connector cannot couple with the second type of connector housing 12 as the reinforcing rib 58 will not engage the receiving slit 60.

Figure 7:
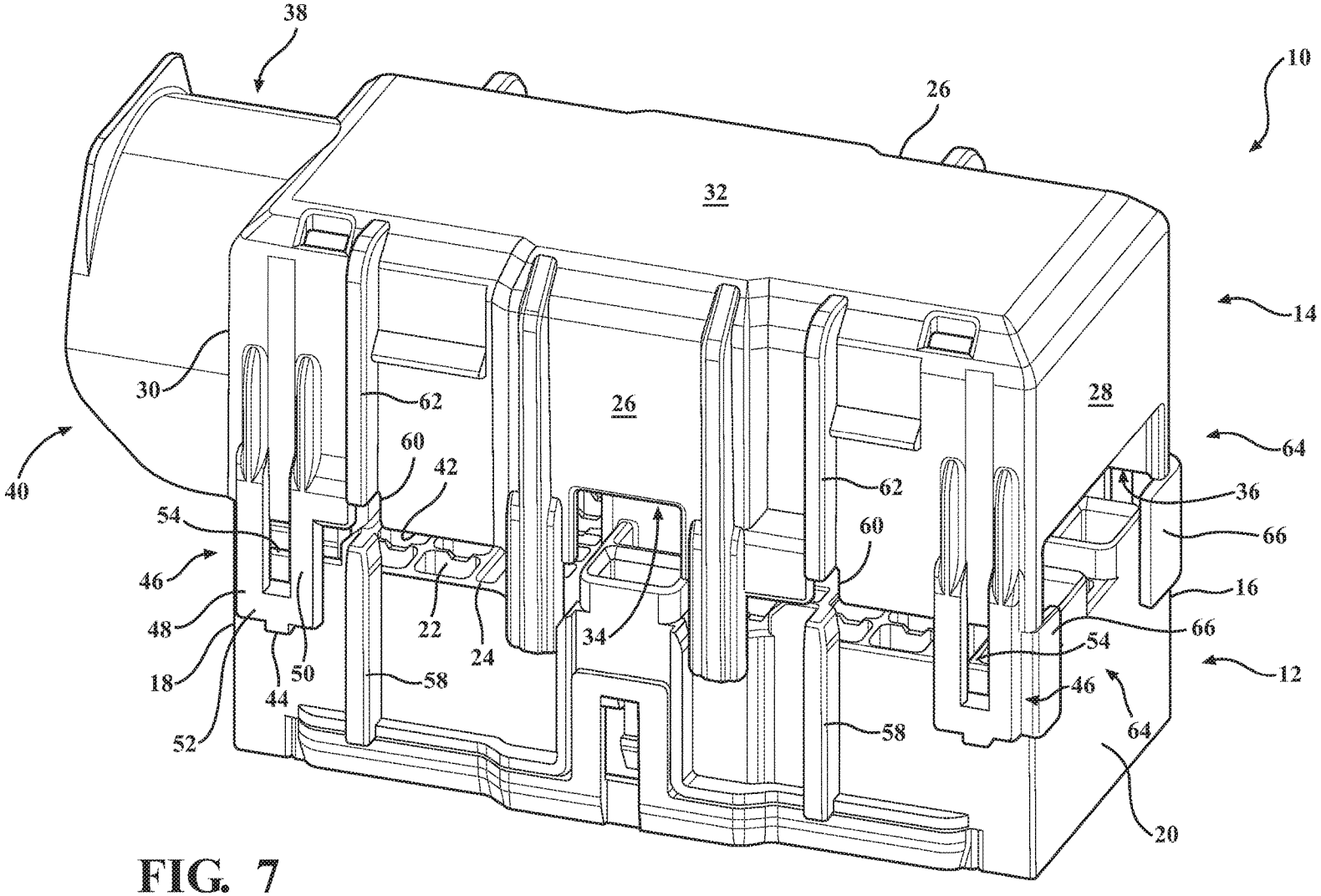
FIG. 7 is an embodiment of a connector assembly having a corner wrap structure.

With reference now to FIG. 7, in one embodiment, the dress cover 14 further includes a corner wrap structure 64. The corner wrap structure 64 is configured to provide reinforcement to the respective locking legs 46 and maintain the spatial relationship between the locking legs 46 and the locking tabs 44. The corner wrap structure 64 is further configured to ride against the first back wall 20 of the connector housing 12.

In one embodiment the dress cover 14 includes a pair of corner wrap structures 64. The corner wrap structures 64 are disposed on the second back wall 28 of the dress cover 14. The corner wrap structures 64 are a generally solid body integrally formed to an elongated member of the locking legs 46. The corner wrap structure 64 includes a connecting portion 66 which extends generally orthogonal to the locking legs 46. The connecting portion 66 is seated against the first back wall 20 of the connector housing so as to resist the load of the compressed bundle of wire from displacing the dress cover 14 forward of the connector housing 12. The pair of corner wrap structures 64 work in concert with the connecting portions 66 to prevent the dress cover 14 from being displaced from the connector housing 12 in a lateral direction as defined by the width of the connector housing 12, e.g. the axis between opposing points of the pair of first side walls 16 of the connector housing 12.

It should be appreciated that the connector assembly 10 may include four corner wrap structures 64, each of the corner wrap structures 64 are disposed on each corner of the dress cover assembly 14 and integrally formed to a respective locking leg 46. In such a manner the dress cover 14 is seated onto the connector housing 12 in such as manner so as to resist the compressive load of the wire bundle in the lateral direction as defined by the width of the connector housing 12 and in a lateral direction as defined by the length of the connector housing 12.

Accordingly, the connector assembly 10 is configured to withstand the forces of a compressed bundle of wire by providing reinforcement to the locking legs 46 in multi planar directions as well as to maintain the spatial relationship of the second side walls 26 so as to prevent the force exerted by the bending wires from breaking the locking legs 46.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A connector assembly configured to withstand the bending force of a wire bundle comprises:

a connector housing, the connector housing includes a pair of side walls opposite of each other, a front wall opposite of a back wall and a plurality of terminal openings, the wire bundle inserted into the plurality of terminal openings, the connector housing further including a locking tab formed on an outer surface of one of the pair of first side walls;

a dress cover having a pair of second side walls, a second top wall, a second back wall and a hood disposed on the second front wall, the hood defining an exit path for which the wire bundle is routed, the dress cover further including a locking leg, the locking leg configured to engage the locking tab;

a reinforcing tab disposed on an inner surface of one of the pair of second side walls and is spaced apart from locking leg, the locking leg and the reinforcing tab cooperate together to pinch the first side wall of the connector housing and help secure the engagement between the locking leg and the locking tab; and wherein the connector housing includes a reinforcing rib and the dress cover includes a receiving slit, wherein the reinforcing rib is disposed on an outer surface of the first side wall and extends beyond the first peripheral edge of the first side wall, and the receiving slit is disposed on the second side wall and is configured to receive the reinforcing rib so as to prevent the dress cover and connector housing from being displaced from each other relative to the axial length of the connector assembly.

2. The connector assembly as set forth in claim 1, wherein the locking tab is ramp shaped.

3. The connector assembly as set forth in claim 2, wherein a top end of the locking tab is flush with the first side surface and angles to a bottom end, the bottom end of the locking tab is planar and is disposed on a plane orthogonal to the first side wall.

4. The connector assembly as set forth in claim 2, the locking leg includes a first elongated member spaced apart from a second elongated member, a bottom end of the first elongated member is connected to a bottom end of the second elongated member by a lip.

5. The connector assembly as set forth in claim 4, wherein the first elongated member and the second elongated member are spaced apart from each other so as to define a slot.

6. The connector assembly as set forth in claim 5, wherein the slot extends along an axis defining the length of the locking leg.

7. The connector assembly as set forth in claim 5, wherein the slot has a width configured to slidingly receive the respective locking tab.

8. The connector assembly as set forth in claim 1, wherein the reinforcing tab is offset from the corresponding locking leg.

9. The connector assembly as set forth in claim 1, wherein the reinforcing tab is directly opposite from the corresponding locking leg.

10. The connector assembly as set forth in claim 1, further including a corner wrap structure, the corner wrap structure is integrally formed to the locking leg and includes a connecting portion which extends orthogonal to the locking leg and is seated against the first back wall of the connector housing.

11. The connector assembly as set forth in claim 10, wherein the corner wrap structure is a pair of corner wrap structures, each of the pair of corner wrap structures is integrally formed to a pair of locking legs.

12. The connector assembly as set forth in claim 11, wherein the pair of corner wrap structures are contiguous with the second back wall of the dress cover.

* * * * *